US006099334A

United States Patent [19]

Togashi

[11] Patent Number: 6,099,334

[45] Date of Patent: Aug. 8, 2000

[54] COAXIAL CONNECTOR WITH SWITCH

[75] Inventor: Koji Togashi, Tokyo, Japan

[73] Assignee: SMK Corporation, Japan

[21] Appl. No.: 09/274,172

[22] Filed: Mar. 23, 1999

[30] Foreign Application Priority Data

Apr. 21, 1998 [JP] Japan ..... 10-110429

[51] Int. Cl.[7] ..... H01R 29/00

[52] U.S. Cl. ..... 439/188; 439/513; 200/51.1

[58] Field of Search ..... 439/188, 513, 439/668, 669, 650, 654, 944; 200/51.1, 51.09, 51.05

[56] References Cited

U.S. PATENT DOCUMENTS

| | | | |
|---|---|---|---|
| 3,878,347 | 4/1975 | Roeser | 200/67 D |
| 3,946,390 | 3/1976 | Alexander et al. | 343/702 |
| 4,628,459 | 12/1986 | Deitch et al. | 200/51.05 |
| 4,666,231 | 5/1987 | Sheesley et al. | 339/177 R |
| 4,825,021 | 4/1989 | Pauza | 200/504 |
| 5,030,121 | 7/1991 | Noorily | 439/188 |
| 5,098,306 | 3/1992 | Noschese et al. | 439/188 |
| 5,264,672 | 11/1993 | Ishii et al. | 200/275 |
| 5,338,215 | 8/1994 | Lee et al. | 439/188 |
| 5,413,494 | 5/1995 | Dewey et al. | 439/188 |
| 5,538,435 | 7/1996 | Yohn | 439/188 |
| 5,601,441 | 2/1997 | Weinstein et al. | 439/188 |
| 5,601,459 | 2/1997 | Seidler | 439/876 |
| 5,625,177 | 4/1997 | Yukinori et al. | 200/1 R |
| 5,741,146 | 4/1998 | Henry et al. | 439/188 |
| 5,882,217 | 3/1999 | Aponte et al. | 439/188 |
| 5,893,767 | 4/1999 | Broschard, III | 439/188 |

*Primary Examiner*—Lincoln Donovan
*Assistant Examiner*—Richard K. Lee
*Attorney, Agent, or Firm*—Morrison Law Firm

[57] ABSTRACT

A resilient, curved switch terminal is elastically flexed when deflected by a connector pin inserted into a coaxial connector. The switch terminal is sufficiently long to provide a broad range of resiliency that accommodates plug pins of various dimensional tolerances. The switch terminal contacts a fixed terminal in a normally closed contact position. A connector pin in a mating connector opens the normally closed contact while making a new contact through the connector pin. The terminals are long enough to prevent solder flux from flowing to contacting portions. Solder flux residue is avoided on contacting portions and a more reliable contact is obtained. The portion of the switch terminal that contacts the plug pin is slanted to prevent accumulation of any contaminants such as dust or plating residue that enters the coaxial connector. The slanted contact portion also facilitates assembly of the coaxial connector switch. The resulting coaxial connector is easier to manufacture and has greater reliability while presenting a thin and compact aspect.

20 Claims, 5 Drawing Sheets

COAXIAL CONNECTOR WITH SWITCH

BACKGROUND OF THE INVENTION

The present invention relates to a coaxial cable connector with a switch. The connector is used with signal transceiver circuits in electronic devices, such as, for example, a portable telephone or a Personal Handy-phone System ("PHS"). The present invention also relates to a structure of the coaxial connector in which a plug pin conductor inserted into the connector causes an internal connection to switch to a connection through the plug pin.

For example, a portable telephone and a PHS each have an attached antenna. An external antenna or testing apparatus can be connected to the transceiver circuits of the portable telephone and PHS devices through the coaxial connector. The switch within the coaxial connector disconnects the attached antenna when the external antenna or testing apparatus is connected. The disconnection of the attached antenna occurs simultaneously with, or slightly later than (make before break), the making of a connection to the external antenna or testing apparatus.

Accordingly, the above described type of coaxial connector is used in a variety of compact electronic devices such as portable telephones, etc. Overall electronic device compactness can be achieved only if the coaxial connector is as compact and as thin as possible.

FIGS. 8 and 9 show a conventional coaxial connector 100 with a switch as disclosed in Japanese Laid-Open (Kokai) Patent No. 9-245907. A fixed terminal 101 and a switch terminal 102 are transversely arranged within a terminal storage chamber 103. The arrangement of terminals 101, 102 allow coaxial connector 100 to be compact and thin. Moreover, this configuration of coaxial connector 100 reliably connects and disconnects plug pin 111 of a mating connector 110.

Coaxial connector 100 has a parallelepiped-shaped insulating case 104. Terminal storage chamber 103 is a concave cavity within insulating case 104. Fixed terminal 101 and switch terminal 102 are located in terminal storage chamber 103. A plug insertion hole 105 is located at an end of terminal storage chamber 103. Plug pin 111 is inserted into and removed from terminal storage chamber 103 through plug insertion hole 105 in a vertical direction.

Fixed terminal 101 is an elongated conductive leaf spring with an end tip portion that extends through a side wall of insulating case 104. The end tip portion projects through insulating case 104 into an upper portion of terminal storage chamber 103. A fixed contact portion 101 a protrudes from a lower face of fixed terminal 101 within terminal storage chamber 103.

Switch terminal 102 is also an elongated conductive leaf spring with an end tip portion that extends through insulating case 104. The end tip portion of switch terminal 102 projects through insulating case 104 into terminal storage chamber 103. Switch terminal 102 extends across terminal storage chamber 103 to oppose fixed terminal 101. A movable contact portion 102*a* is located on the end tip portion of switch terminal 102. Movable contact portion 102*a* resiliently contacts fixed contact portion 101*a*. Switch terminal 102 also has an intermediate portion on which is located a plug contact portion 102*b*. Plug contact portion 102*b* is located below plug insertion hole 105. When mating connector 110 is inserted into plug insertion hole 105, plug pin 111 connects with plug contact portion 102*b*.

The other end portions of fixed terminal 101 and switch terminal 102 wrap around an external surface of insulating case 104. These end portions extend along a bottom surface of insulating case 104 to form lead portions 101*b* and 102*c*. Lead portions 101*b*, 102*c* are connected to a surface circuit pattern on a printed wiring board (not shown). Terminals 101, 102 are fixed to insulating case 104 by the portions that wrap around insulating case 104. Switch terminal 102 is thereby arranged to be a cantilever capable of flexing within terminal storage chamber 103.

As shown in FIG. 8, movable contact portion 102*a* resiliently contacts fixed contact portion 101*a* prior to the insertion of mating connector 110. Contact between movable contact portion 102*a* and fixed contact portion 101*a* is maintained by a spring-type force applied by switch terminal 102. Switch terminal 102 flexes slightly to provide resilient contact between movable contact portion 102*a* and fixed contact portion 101*a*. The contact maintained between movable contact portion 102*a* and fixed contact portion 101*a* provides an electrical connection between terminals 101, 102.

FIG. 9 shows mating connector 110 inserted into coaxial connector 100. In this configuration, an end tip portion of plug pin 111 contacts movable contact portion 102*b* of switch terminal 102. Plug pin 111 presses against switch terminal 102, causing switch terminal 102 to resiliently flex in a downward direction. When switch terminal 102 is flexed in this way, contact between movable contact portion 102*a* and fixed contact portion 101*a* is broken. Thus when mating connector 110 is inserted into coaxial connector 100, the connection between fixed terminal 101 and switch terminal 102 is broken, while a connection between plug pin 111 and switch terminal 102 is made.

In this configuration, fixed terminal 101 and switch terminal 102 are arranged transversely within terminal storage chamber 103. The direction of insertion of mating connector 110 is perpendicular to fixed contact portion 101*a* and movable contact portion 102*a*. This configuration allows for flexible construction parameters because the dimensions of coaxial connector 100 are not completely determined by the length of plug pin 111 and the longitudinal lengths of terminals 101, 102. The flexibility provided by this configuration allows coaxial connector 100 to have a very thin and compact construction.

The above described configuration of coaxial connector 100 accepts insertion of a mating connector 110 which has a plug pin 111 of relatively coarse dimensions. The insertion stroke of plug pin 111 causes switch terminal 102 to flex in a direction perpendicular to the direction of the insertion stroke. However, when the rough dimensions of plug pin 111 are greater than the range which coaxial connector 100 can accommodate, switch terminal 102 is deflected beyond its resilient flexure range. Once switch terminal 102 is deflected beyond its resilient flexure range, it is plastically deformed and cannot completely return to its predetermined position. This plastic deformation results in improper operation of coaxial connector 100.

One factor which determines the resilient flexure range of switch terminal 102 is its length within terminal storage chamber 103. Plastic deformation of switch terminal 102 can therefore be avoided by increasing its length. A desired resilient flexure range can be achieved by setting the length of switch terminal 102 to a desired value. However, increasing the length of switch terminal 102 results in an attendant increase in the width of coaxial connector 100. Therefore, when a desired resilient flexure range is implemented, the thinness and compactness of coaxial connector 100 is limited by the length of switch terminal 102. The dimensions of coaxial connector 100 must be increased to a range greater than desired if it is to accept a mating connector 110 with coarse dimensions. The increased dimensions of coaxial connector 100 results in an undesirable overall loss of compactness for the electronic device to which it is attached.

The compactness of insulating case 104 is also restrained by the length of switch terminal 102. Accordingly, the area occupied by coaxial connector 100 when mounted to a printed wiring board is increased. The resulting increase in area required on the printed circuit board creates an undesirable reduction in mounting density.

In addition, it is desirable to make insulating case 104 as thin as possible to increase the compactness of coaxial connector 100. When insulating case 104 is made to be as thin as possible, the length of fixed terminal 101 from lead portion 101*b* to fixing electrode 101*a* is reduced. Coaxial connector 100 is soldered onto a printed wiring board with lead portion 101*b* being connected to a printed wiring board pattern by the solder. During the soldering process, soldering flux travels along fixed terminal 101 and tends to build up on fixed contact portion 101*a*. The build up of flux tends to result in imperfect contact being made between fixed contact portion 101*a* and movable contact portion 102*a*.

OBJECTS AND SUMMARY OF THE INVENTION

In view of the foregoing, it is an object of the present invention to provide a coaxial connector with a switch which overcomes the above-described drawbacks of the prior art.

It is a further object of the present invention to provide a coaxial connector with a switch which is compact and thin.

It is a further object of the present invention to provide a coaxial connector with a switch that does not limit the compactness of an electronic device to which it is attached.

It is a further object of the present invention to provide a coaxial connector with a switch that is compact and thin and is capable of receiving a mating connector with varying dimensional tolerances.

It is a further object of the present invention to provide a coaxial connector with a switch that avoids plastic deformation of connecting terminals.

It is a further object of the present invention to provide a coaxial connector with a switch that avoids the build up of solder flux on any of the terminals.

It is a further object of the present invention to provide a coaxial connector with a switch in which switch terminals provide reliable contact connections.

It is still another object of the invention to provide a coaxial connector with a switch that avoids a build-up of contaminants within the coaxial connector.

Briefly stated, the present invention provides a resilient, curved switch terminal that is elastically flexed when deflected by a connector pin inserted into a coaxial connector. The switch terminal is sufficiently long to provide a broad range of resiliency that accommodates plug pins of various dimensional tolerances. The switch terminal contacts a fixed terminal in a normally closed contact position. A connector pin in a mating connector opens the normally closed contact while making a new contact through the connector pin. The terminals are long enough to prevent solder flux from flowing to contacting portions. Solder flux residue is thereby avoided on contacting portions and a more reliable contact is obtained. The portion of the switch terminal that contacts the plug pin is slanted to prevent accumulation of any contaminants such as dust or plating residue that enters the coaxial connector. The slanted contact portion also facilitates assembly of the coaxial connector switch. The resulting coaxial connector is easier to manufacture and has greater reliability while presenting a thin and compact aspect.

To achieve the above objects, a coaxial connector with a switch comprises: a housing in which a terminal storing chamber is formed. A plug insertion hole communicating with the terminal storing chamber is formed in the housing. A plug pin of an opposite side connector is freely inserted into and withdrawn from the terminal storing chamber. A fixed terminal with a fixed contact portion is transversally arranged within the terminal storing chamber. A switch terminal with a movable contact portion resiliently contacts the fixed contact portion of the fixed terminal. A plug contact portion facing the plug insertion hole is also transversally arranged within the terminal storing chamber. The plug contact portion and the plug pin contact each other to interrupt the contact of the movable contact portion and the fixed contact portion. The coaxial connector with the switch is constructed such that the switch terminal is curved in an S-shape in its longitudinal direction. A mounting portion the switch terminal is cantilevered from one side of the terminal storing chamber in its transversal direction. The fixed terminal is supported by a side of the terminal storing chamber in a transversal direction. The movable contact portion is located on a curved portion of the switch terminal and resiliently contacts the fixed contact portion of the fixed terminal. A portion of the switch terminal extends from the movable contact portion across the plug insertion hole. The plug contact portion of the switch terminal is located on this portion that extends across the plug insertion hole. When the plug pin is inserted into the plug insertion hole, it contacts the switch terminal at the plug contact portion to actuate the switch.

The movable contact portion resiliently contacts the fixed contact portion in a normally closed arrangement. The spring-like property of the switch terminal that provides this resiliency results from the switch terminal being curved in an S-shape. When the plug pin is inserted into the plug insertion hole and contacts the plug contact portion, the switch terminal is electrically connected to the plug pin. Furthermore, the entire cantilevered switch terminal is flexed so that the contact between the movable contact portion and the fixed contact portion is interrupted. When the plug pin is pulled out of the plug insertion hole, the switch terminal resiliently returns to its normally closed position and the movable contact portion again contacts the fixed contact portion.

Since the switch terminal is curved in an S-shape along its longitudinal length and one end is cantilevered, the flexing portion can be set to a relatively long length even when the housing is compact and thin.

The movable contact portion of the switch terminal is located on a curved portion of the switch terminal. Accordingly, the movable contact portion resiliently contacts the fixed contact portion of the fixed terminal over a distance extending to the plug insertion hole. The plug contact portion of the switch terminal extends across and faces the plug insertion hole. The fixed terminal is supported from the other side of the terminal storing chamber in a transversal direction. The fixed terminal extends around the plug insertion hole to the location of the fixed contact portion. Therefore, the entire length of the fixed terminal can be made sufficiently long to avoid solder flux flow from reaching the fixed contact portion when the fixed terminal is soldered to a printed wiring board.

An end tip portion of the switch terminal is inclined from the movable contact portion toward the plug contact portion in a direction away from the plug insertion hole. Either of the switch terminal or the fixed terminal is fixed within the terminal storing chamber while the other terminal is attached.

Since the end tip portion of the switch terminal is inclined, there is no interference between the switch terminal and the fixed contact portion of the fixed terminal. Accordingly, the switch terminal or the fixed terminal can be smoothly assembled with no limitation on which terminal is first fixed within the terminal storage chamber.

The coaxial connector can be oriented in a horizontal or vertical direction. When the coaxial connector is oriented in the horizontal direction, the end tip portion of the switch terminal is slanted downward from the movable contact portion. Accordingly, external contaminants such as dust or plating residue do not remain on the end tip portion of the switch terminal and do not become attached to the movable contact portion.

The coaxial connector has a switch terminal that is curved in an S-shape along a longitudinal direction of the terminal. A movable portion of the switch terminal can be set to a sufficient length to avoid plastic deformation of the terminal when flexed. The switch terminal thus configured has sufficient resiliency even when placed within a narrow terminal storage chamber. Accordingly, the coaxial connector can be constructed to be compact and thin while maintaining operational functionality and avoiding plastic deformation of the switch terminal.

The terminals in the coaxial connector are set to be of sufficient length to ensure that no flux reaches the terminal contact portions when the coaxial connector is soldered to a printed wiring board.

An end tip portion of the switch terminal is inclined downward within a terminal storage chamber to avoid interference with other terminals when the coaxial connector is assembled.

A movable contact portion is located above a plug pin contact portion by inclining the end tip portion of the switch terminal downward. Accordingly, external dust or plating residue that falls through a plug insertion hole onto the plug contact portion does not remain on the contact portion. The contaminates instead move downward toward the end tip portion of the terminal away from contact portions.

According to an embodiment of the present invention, there is provided a coaxial connector with a switch comprising: an insulative housing, at least one connector opening in a wall of the housing, at least one first terminal rigidly affixed in the housing, a terminal opening in the first terminal, the terminal opening substantially aligned with the at least one connector opening, at least one second terminal having a first end and a second end, the first end rigidly affixed to the housing, the second end facing the at least one connector opening with the at least one first terminal interposed therebetween, the second end being resiliently urged toward the at least one first terminal, and the at least one second terminal being exposed to the at least one connector opening to permit deflection of the at least one second terminal away from the at least one connector opening by insertion of a mating connector having a connector pin, whereby a connection between the at least one first terminal and the at least one second terminal is opened.

According to another embodiment of the present invention, there is provided a coaxial connector with a switch comprising: an insulative housing, at least one conductive strip on an exterior of the housing, at least one connector opening in a wall of the housing, at least one first terminal rigidly affixed in the housing, a terminal opening in the at least one first terminal, the terminal opening substantially aligned with the at least one connector opening, at least one second terminal having a first end and a second end, the first end rigidly affixed to the housing, the second end facing the at least one connector opening with the at least one first terminal interposed therebetween, the second end being resiliently urged toward the at least one first terminal, and the at least one second terminal being exposed to the at least one connector opening to permit deflection of the at least one second terminal away from the at least one connector opening by insertion of a mating connector having a connector pin, whereby a connection between the at least one first terminal and the at least one second terminal is opened.

According to still another embodiment of the present invention, there is provided a coaxial connector with a switch comprising: at least one fixed terminal including an opening, a fixed contact on a side of the opening, at least one switch terminal curved in an S-shape, the at least one switch terminal including a movable contact and a connector contact, the at least one switch terminal opposed to the opening and resiliently urged toward the at least one fixed terminal, whereby the fixed contact and the movable contact connect, the connector contact being externally accessible, and the connector contact capable of being connected to and deflected by an external connector, whereby the at least one switch terminal resiliently flexes and opens a connection between the fixed contact and the movable contact.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Referring now to FIGS. 1–6, a coaxial connector 1 that has a switch is shown.

Figure 1:
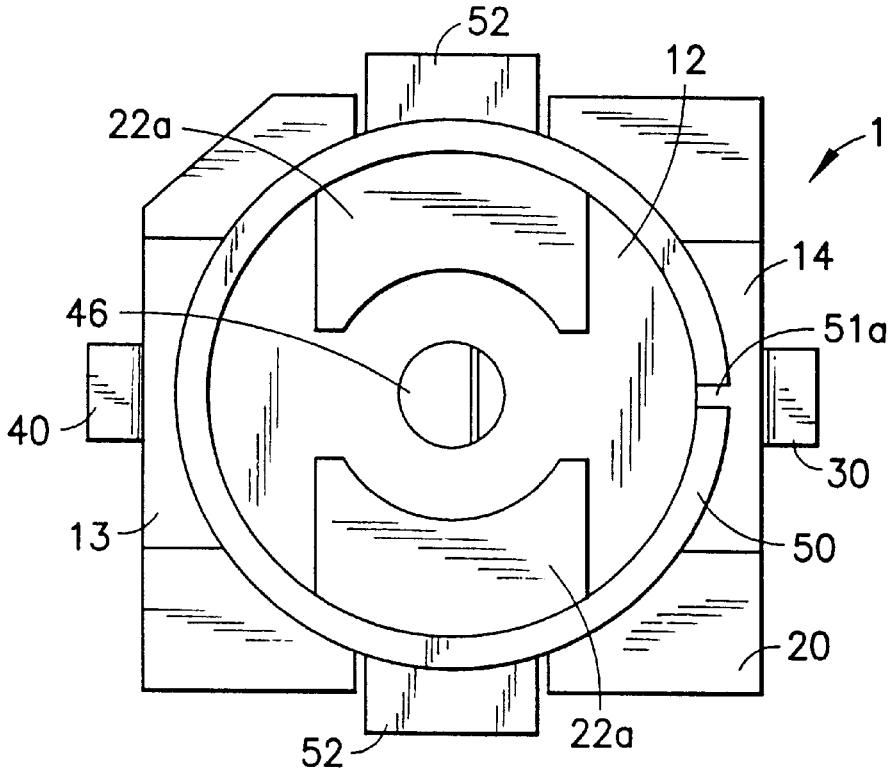
FIG. 1 is a plan view of a coaxial connector with a switch in accordance with one embodiment mode of the present invention.
Figure 2:
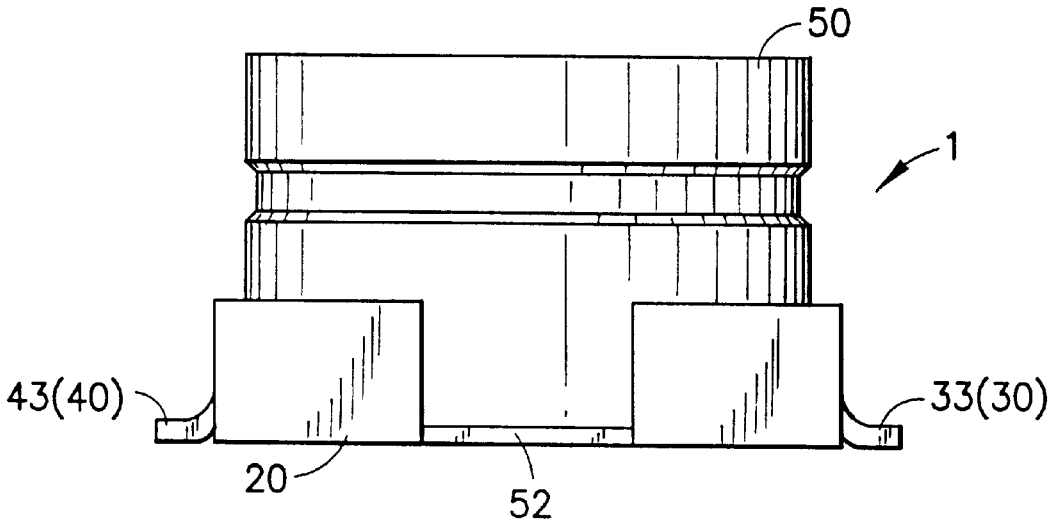
FIG. 2 is a front view of the coaxial connector shown in FIG. 1.
Figure 3:
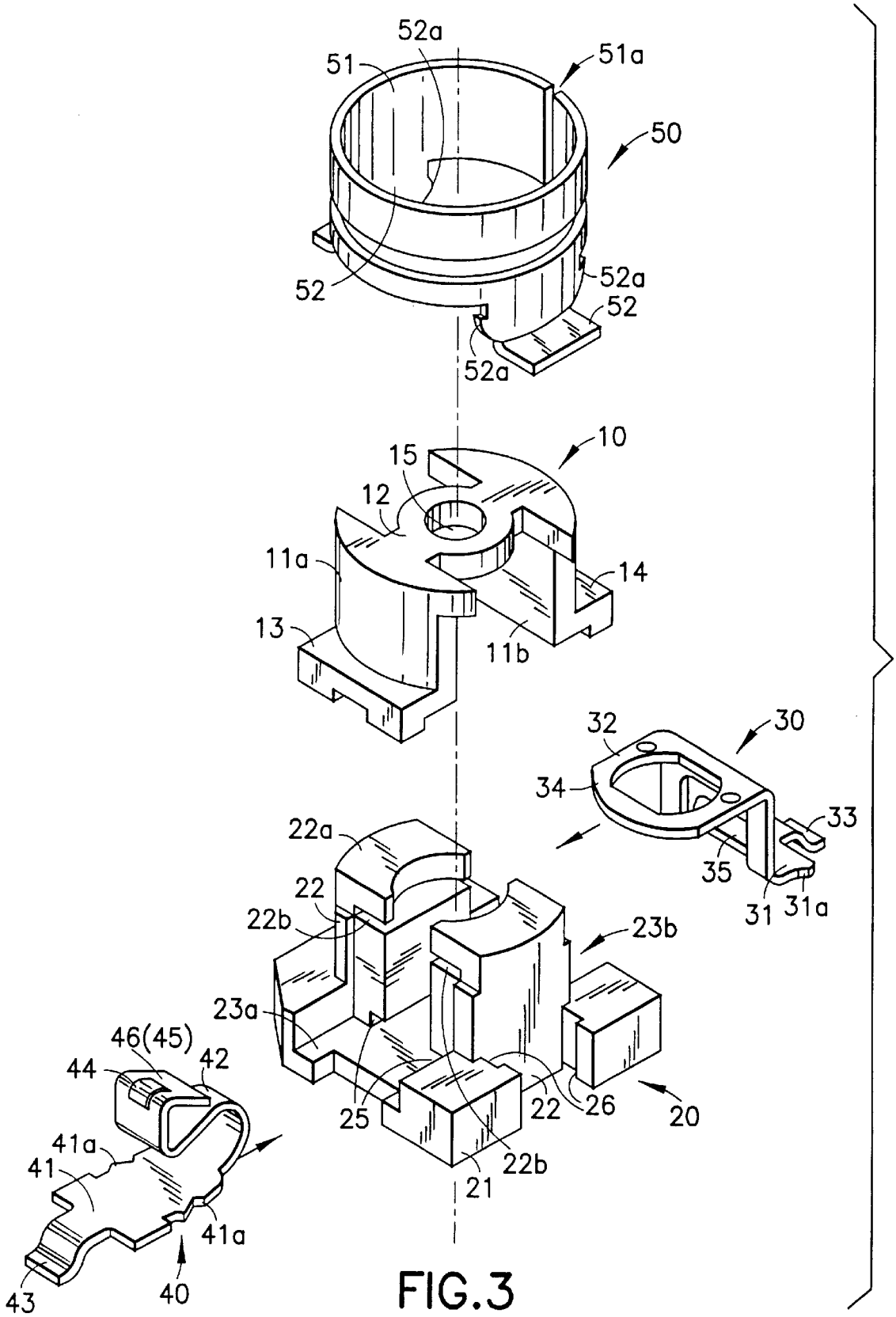
FIG. 3 is an exploded perspective view of the coaxial connector of FIGS. 1 and 2.

Referring first to FIG. 3, a coaxial connector 1 includes a fundamental base 20. A fixed terminal 30 is attached on one side of fundamental base 20 at a base 21. A switch terminal 40 is attached on another side of fundamental base 20 at base 21. An insulating cover 10 is positioned on fundamental base 20 to enclose fixed terminal 30 and switch terminal 40. Insulating cover 10 and fundamental base 20 are composed of an insulating synthetic resin. Housing 2 is formed by the combination of insulating cover 10 and fundamental base 20. A sleeve-shaped earth shell 50 is placed over housing 2 to form the coaxial connector 1 with a switch.

Two fitting sleeve portions 11*a*, 11*b* are disposed on opposing sides of insulating cover 10. Fitting sleeve portions 11*a*, 11*b* are integrally connected to each other through an upper face portion 12. Upper face portion 12 and fitting sleeve portions 11*a*, 11*b* have inner wall faces that form a portion of terminal storage chamber 3 in housing 2. Two flange portions 13, 14 project from lower external portions of fitting sleeve portions 11*a*, 11*b*, respectively. Flange portion 13 covers a pulling-out portion 31 of fixed terminal 30, while flange portion 14 covers a pulling-out portion 41 of switch terminal 40.

Upper face portion 12 forms a portion of a top inner wall of terminal storage chamber 3. A plug insertion hole 15 for receiving plug pin 111 is formed in a center of upper face portion 12. Plug insertion hole 15 acts as a guide for plug pin 111 so that insertion and removal of plug pin 111 occurs in a vertical direction.

Fundamental base 20 is shaped to form a complementary fit for insulating cover 10. For example, the curvature of the outer circumferential faces of a pair of divisional sleeve portions 22, 22 matches the curvature of fitting sleeve portions 11*a*, 11*b*. Divisional sleeve portions 22, 22 project upward from a base 21. Base 21 is formed in a thick plate shape on a lower portion of fundamental base 20. The contours of upper faces 22*a*, 22*a* of divisional sleeve portions 22, 22 are formed in a complementary shape to a contour of upper face portion 12.

When insulating cover 10 is placed on fundamental base 20, external surfaces of fitting sleeve portions 11*a*, 11*b* and divisional sleeve portions 22, 22 form a cylinder. In addition, terminal storage chamber 3 is formed in a rectangular parallelepiped shape by the internal wall surfaces of fitting sleeve portions 11*a*, 11*b* and divisional sleeve portions 22, 22. The top of terminal storage chamber 3 is defined by the internal surfaces of upper faces 22*a*, 22*a* and upper face portion 12.

Guide recessed portions 23*a*, 23*b* are concavely formed to extend across an upper face of base 21 on each of their respective sides of base 21. Guide recessed portions 23*a*, 23*b* are adapted to receive flange portions 13, 14, respectively, of insulating cover 10 in a complementary fit. Two recesses are formed on edges of base 21 below guide recessed portions 23*a*, 23*b*. When insulating cover 10 is fitted to fundamental base 20, a continuous gap is formed between flange portion 13 and guide recessed portion 23*a*. This continuous gap in conjunction with a corresponding recess on an edge of base 21 accommodates a switch terminal leg portion 43 of switch terminal 40. Similarly, a continuous gap is formed between flange portion 14 and guide recessed portion 23*b*. This continuous gap in conjunction with a corresponding recess on another edge of base 21 accommodates a fixed terminal leg portion 33 of fixed terminal 30. Guide recessed portions 23*a*, 23*b* also provide a means for respectively guiding fixed terminal leg portion 33 and switch terminal leg portion 43 onto a bottom face side of base 21.

Figure 6:
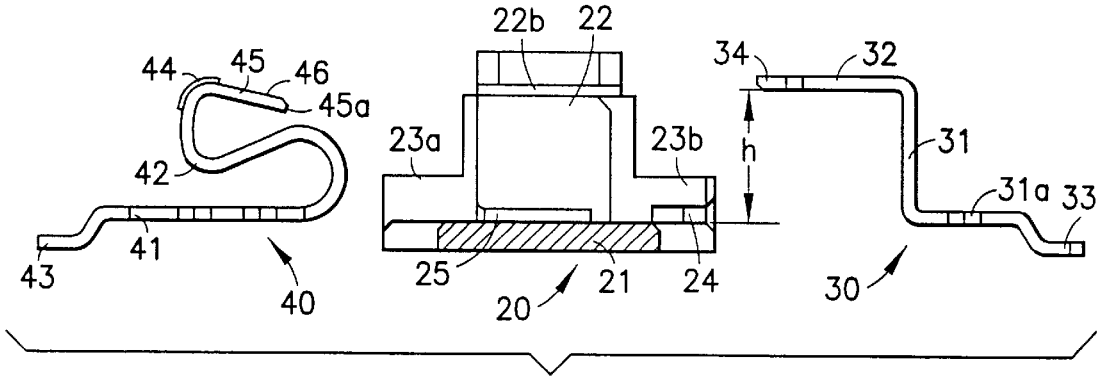
FIG. 6 is a partially longitudinal sectional view showing an assembly method according to the present invention.

Referring momentarily to FIG. 6, a fixed terminal engaging groove 24 is formed in a lower portion of guide recessed portion 23*b*. A switch terminal engaging groove 25 is formed on a lower inner surface of each one of divisional sleeve portions 22, 22. A lower surface of switch terminal engaging groove 25 is continuous with guide recessed portion 23*a*.

Referring again to FIG. 3, an earth shell engaging groove 26 is formed on an outer circumferential face of each one of divisional sleeve portions 22, 22. Fixed terminal 30, switch terminal 40 and sleeve-shaped earth shell 50 are respectively received and fixed to fundamental base 20 with fixed terminal engaging groove 24, switch terminal engaging groove 25 and earth shell engaging groove 26.

Fixed terminal 30 is formed by first punching a thin conductive metallic plate pattern out of suitable stock. The conductive metallic plate is then bent into a two-stage step shape. A ring plate portion 32 defines an opening on an upper step portion of fixed terminal 30. A fixed terminal leg portion 33 is formed on another stepped end of fixed terminal 30, together with a horizontal area of pulling-out portion 31. A pair of engaging projections 31*a*, 31*a* are located on either side of the horizontal area of pulling-out portion 31. Each of engaging projections 31*a*, 31*a* project from the horizontal area of pulling-out portion 31 in a horizontal direction. Horizontal and vertical areas of pulling-out portion 31 also connect ring plate portion 32 and fixed terminal leg portion 33 to form a step shape. A fixed contact portion 34 is located on an end tip portion of ring plate portion 32. An escape hole 35 defines is formed as an opening in the vertical area of pulling-out portion 31. Escape hole 35 forms an insulating clearance between fixed terminal 30 and switch terminal 40 when the terminals are attached to fundamental base 20. The width of ring plate portion 32 is slightly narrower than the distance between guide grooves 22*b*, 22*b* that are formed on opposed upper inner surfaces of divisional sleeve portions 22, 22.

Referring momentarily again to FIG. 6, when fixed terminal 30 is attached to fundamental base 20, ring plate portion 32 is inserted between guide grooves 22*b*, 22*b*. Fixed terminal 30 is then press-fitted into fundamental base 20. As ring portion 32 is further pressed into fundamental base 20, both sides of the horizontal area of pulling-out portion 31 are press-fitted into fixed terminal engaging groove 24. When fixed terminal 30 has been press-fitted entirely into fundamental base 20, each of engaging projections 31*a*, 31*a* engage an inner surface of fixed terminal engaging groove 24. Once attached as described, ring portion 32 in guide grooves 22*b*, 22*b* and pulling-out portion 31 and engaging projections 31*a*, 31*a* in fixed terminal engaging groove 24 prevent removal of fixed terminal 30 from fundamental base 20.

Referring again to FIG. 3, when insulating cover 10 and fundamental base 20 are assembled to form housing 2, fitting sleeve portion 11*b* forms an inner wall of terminal storage chamber 3. In this configuration, fixed terminal 30 is supported in a transverse direction by the inner wall of terminal storage chamber 3 defined by fitting sleeve portion 11*b*. Ring plate portion 32 of fixed terminal 30 is arranged along an inner top surface of terminal storing chamber 3. In addition, ring plate portion 32 is positioned to be substantially concentric with plug insertion hole 15. Accordingly, fixed contact portion 34 is located near an upper portion of terminal storage chamber 3 corresponding to an upper portion of fitting sleeve portion 11*a*. Conversely, fixed terminal leg portion 33 extends from a lower portion of housing 2 that is formed as a gap which communicates with terminal storage chamber 3. This gap in housing 2 is formed by portions of guide receiving portion 23*b* and a recess located on an edge of base 21. The gap communicates with terminal storage chamber 3 so that fixed terminal 30 can continuously extend from an exterior of coaxial connector 1 to an interior of terminal storage chamber 3. As fixed terminal leg portion 33 extends from housing 2, it runs parallel with a bottom face of fundamental base 20.

Switch terminal 40 is formed in much the same way as fixed terminal 30. A thin, conductive metallic plate is punched into an elongated shape. The plate is then bent in various steps to form switch terminal 40. Switch terminal 40 is thus integrally formed with an S-shaped bent portion 42 and an end tip portion 45 along a longitudinal direction. Switch terminal 40 also includes pulling-out portion 41 and switch terminal leg portion 43 continuously comes with a S-shaped bent portion 42. Pulling-out portion 41 includes engaging projections 41*a*, 41*a* that project laterally from side portions of pulling out portion 41.

When switch terminal 40 is attached to fundamental base 20, both sides of pulling-out portion 41 are press-fitted into switch terminal engaging grooves 25, 25 in base 21. When switch terminal 40 has been press-fitted entirely into base 21, each of engaging projections 41*a*, 41*a* engage an inner surface of switch terminal engaging grooves 25, 25. Once switch terminal 40 is attached to fundamental base 20, press-fitted pulling-out portion 41 and engaging projections 41*a*, 41*a* engage base 21 to prevent removal of switch terminal 40.

In this arrangement, switch terminal 40 is cantilevered by base 21 of fundamental base 20. Switch terminal 40 can therefore resist and absorb forces applied from a vertical direction.

Figure 4:
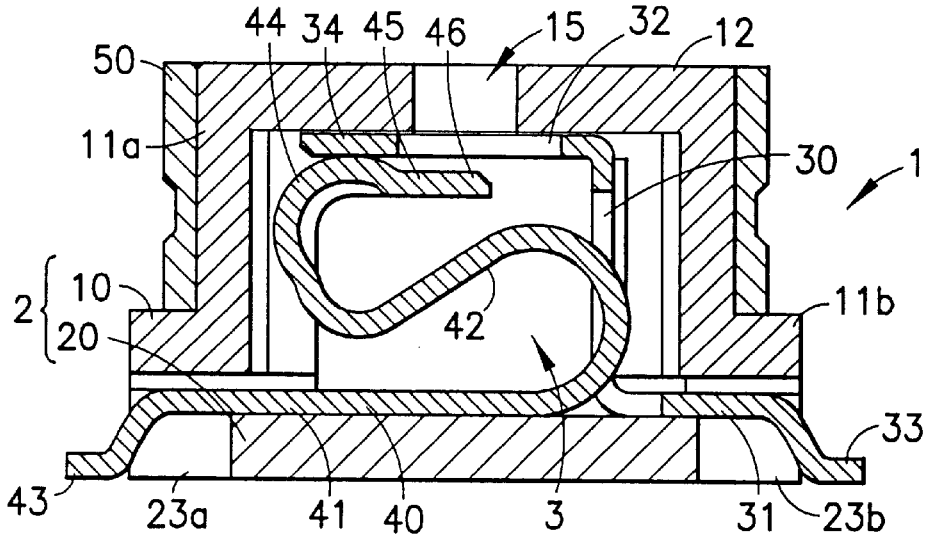
FIG. 4 is a longitudinal sectional view of a coaxial connector according to one embodiment of the present invention.

Referring now to FIG. 4, S-shaped bent portion 42 has a curved section near pulling-out portion 41 that protrudes into escape hole 35 of fixed terminal 30. Flexure of S-shaped bent portion 42 causes the curved section near pulling-out portion 41 to protrude farther into and through escape hole 35. No contact between S-shaped bent portion 42 and fixed terminal 30 occurs, however. Escape hole 35 provides an opening large enough to allow substantial protrusion of S-shaped bent portion 42 without contact between switch terminal 40 and fixed terminal 30. In the configuration shown in FIG. 4, S-shaped bent portion 42 is flexed slightly to maintain a contact force that urges end tip portion 45 toward ring plate portion 32 of fixed terminal 30. When S-shaped bent portion 42 is in this position, end tip portion 45 is inclined slightly downward. End tip portion 45 is thus a shorter distance from a bottom face of terminal storage chamber 3 than is a top section of S-shaped bent portion 42.

Referring to FIG. 6, the height of switch terminal 40 measured in a vertical direction is slightly greater than that of fixed terminal 30. An end tip 45*a* of end tip portion 45 is slanted linearly downward from a top of S-shaped bent portion 42. End tip 45*a* is thus slightly closer to the bottom face of terminal storage chamber 3 than is a top of S-shaped bent portion 42. That is, the distance from the bottom face of terminal storage chamber 3 to end tip 45*a* is slightly less than a height h. Height h is the distance from a bottom face of terminal storage chamber 3 to a bottom side of ring plate portion 32 of fixed terminal 30.

Since end tip 45*a* is inclined downward as described above, a clearance is formed between end tip 45*a* and ring plate portion 32 of fixed terminal 30. This clearance allows switch terminal 40 to be press-fitted to fundamental base 20 with no interference from fixed terminal 30. Similarly, fixed terminal 30 is press-fitted to fundamental base 20 with no interference from switch terminal 40. Fixed contact portion 34 of fixed terminal 30 slides over end tip portion 45 during assembly, resulting in a smoother manufacturing process.

Referring again to FIG. 4, when switch terminal 40 is press-fitted to fundamental base 20, fixed contact portion 34 of fixed terminal 30 slides over a sliding portion of switch terminal 40. Fixed contact portion 34 slides over switch terminal 40 until contact is made with a movable contact portion 44. Movable contact portion 44 is located on an upper end of S-shaped bent portion 42. End tip portion 45 is maintained in a downward incline during the press-fitting and assembly process. When both switch terminal 40 and fixed terminal 30 are respectively press-fitted into the positions shown in FIG. 4, movable contact portion 44 contacts fixed contact portion 34. Fixed contact portion 34, movable contact portion 44 and a plug contact portion 46 are thus arranged transversely within terminal storage chamber 3. In this arrangement, plug contact portion 46 of switch terminal 40 is located below plug insertion hole 15 in a vertical direction. Switch terminal 40 is thus configured to contact plug pin 111 at plug contact portion 46 when mating connector 110 is inserted into coaxial connector 1.

Switch terminal leg portion 43 of switch terminal 40 extends externally to coaxial connector 1 near a bottom face side of fundamental base 20. Guide recessed portion 23*a* communicates with terminal storage chamber 3 to provide a passage. Switch terminal leg portion 43 extends from terminal storage chamber 3 through this passage to an external portion of coaxial connector 1. A bottom face of switch terminal leg portion that is external to coaxial connector 1 is substantially parallel with a bottom face of fundamental base 20.

Referring now to FIG. 3, sleeve-shaped earth shell 50 is shown including an earth shell body 51 and a pair of earth leg portions 52, 52. Earth shell body 51 is formed in a substantially cylindrical shape by bending a conductive metallic plate. Earth leg portions 52, 52 extend vertically from opposing lower sides of earth shell body 51. A slot 51*a* extends vertically from a top edge to a bottom edge of earth shell body 51. Slot 51*a* expands as earth shell body 51 is widened to fit over an outer circumferential face of a substantially cylindrical portion of housing 2. A pair of engaging projections 52*a* are located on each of earth leg portions 52, 52. Engaging projections 52*a* are disposed on substantially vertical outer edges of each of earth leg portions 52. When sleeve-shaped earth shell 50 is attached to housing 2, earth leg portions 52, 52 are received in respective earth shell engaging grooves 26, 26 of fundamental base 20. As earth leg portions 52, 52 slide into earth shell engaging grooves 26,26, engaging projections 52*a* engage the inner surfaces of shell engaging grooves 26, 26. Once engaging projections 52*a* engage with earth shell engaging grooves 26, 26, the removal of sleeve-shaped earth shell 50 from housing 2 is prevented.

Each one of earth leg portions 52, 52 is bent perpendicular to a vertical axis of sleeve-shaped earth shell 50. The perpendicular bend is located at an intermediate section of earth leg portions 52, 52. A lower face of earth leg portions 52, 52 bent as described above is parallel with a bottom face of fundamental base 20. The lower face of: perpendicularly bent earth leg portions 52, 52; fixed terminal leg portion 33; switch terminal leg portion 43; and fundamental base 20 are all substantially in the same plane. This arrangement is completed when sleeve-shaped earth shell 50 is fixed to the fundamental base 20 as described above.

Assembly of coaxial connector 1 begins with attaching fixed terminal 30 and switch terminal 40 to fundamental base 20. The terminals are inserted into fundamental base 20 on opposing sides as shown in FIG. 6. Fixed terminal 30 and switch terminal 40 may be inserted one before the other or simultaneously. As they are inserted, pulling-out portions 31 and 41 slide into fixed terminal engaging grooves 24 and switch terminal engaging grooves 25, respectively. Fixed terminal 30 and switch terminal 40 are press-fitted into fundamental base 20, whereupon engaging projections 31*a*and 41*a* engage inner walls of fixed terminal engaging grooves 24 and switch terminal engaging grooves 25, respectively. When fixed terminal 30 is press-fitted to fundamental base 20, fixed contact portion 34 of fixed terminal 30 slides on end tip portion 45 of switch terminal 40. Fixed contact portion 34 sliding on end tip portion 45 provides for a smooth attachment process of fixed terminal 30 and switch terminal 40 to fundamental base 20.

Assembly continues with insulating cover 10 being placed on the assembled fundamental base 20. When insulating cover 10 is placed on fundamental base 20, fitting sleeve portions 11*a*, 11*b* fit between divisional sleeve portions 22, 22 to form inner walls of terminal storage chamber 3 and substantially cylindrical external walls of housing 2. Flange portions 13, 14 fit into guide recessed portions 23*a*, 23*b*, respectively. Pulling-out portions 41 and 31, are supported between flange portions 13, 14 and guide recessed portions 23*a*, 23*b*, respectively.

Once housing 2 is formed by combining insulating cover 10 with fundamental base 20, sleeve-shaped earth shell 50 is attached. Earth shell body 51 of sleeve-shaped earth shell 50 fits over the outer circumferential face of housing 2. When earth shell body 51 slides over housing 2, earth leg portions 52, 52 are received in engaging grooves 26,26. Engaging projections 52*a* of earth leg portions 52, 52 engage the inner surfaces of engaging grooves 26,26 as earth shell body 51 slides farther onto housing 2. Insulating cover 10 is supported by flange portions 13, 14 between guide recessed portions 23*a*, 23*b* as sleeve-shaped earth shell 50 is fixed to fundamental base 20. Once sleeve-shaped earth shell 50 is fully attached to fundamental base 20, it becomes part of the integrated unit including insulating cover 10 and fundamental base 20.

Referring now to FIG. 4, when coaxial connector 1 is assembled as described above, movable contact portion 44 of switch terminal 40 resiliently contacts fixed contact portion 32 of fixed terminal 30. In addition, plug contact portion 46 faces plug insertion hole 15 from inside terminal storage chamber 3.

Lower faces of fixed terminal leg portion 33, switch terminal leg portion 43 and earth leg portions 52, 52 are all in substantially the same plane as a lower face of fundamental base 20. This configuration provides coaxial connector 1 with the facility of surface mounting on a printed wiring board (not shown). When coaxial connector 1 is mounted on a printed wiring board, each of leg portions 33, 43 and 52 are soldered onto a corresponding connection included in the pattern on the printed wiring board. In such a configuration, fixed terminal leg portion 33 is electrically connected to an attached antenna of a portable telephone through the pattern on the printed wiring board. Similarly, switch terminal leg portion 43 is electrically connected to a signal transmit-receive circuit of the portable telephone through the pattern on the printed wiring board. Finally, earth leg portion 52 is electrically connected to an earth pattern (ground) on the printed wiring board.

Operation of coaxial connector 1 is described with reference to FIG. 4 prior to connection with a mating connector 110. Movable contact portion 44 of switch terminal 40 resiliently contacts fixed contact portion 34 of fixed terminal 30. The resilience of S-shaped bent portion 42 provides a force that urges movable contact portion 44 in an upward vertical direction. Fixed contact portion 34 is aligned with movable contact portion 44 in a vertical direction. Since movable contact portion 44 is urged upward, it resiliently contacts fixed contact portion 34. The above discussed attached antenna and signal transmit-receive circuit are electrically connected to each other through terminals 30 and 40 and the patterns on the printed wiring board.

Figure 5:
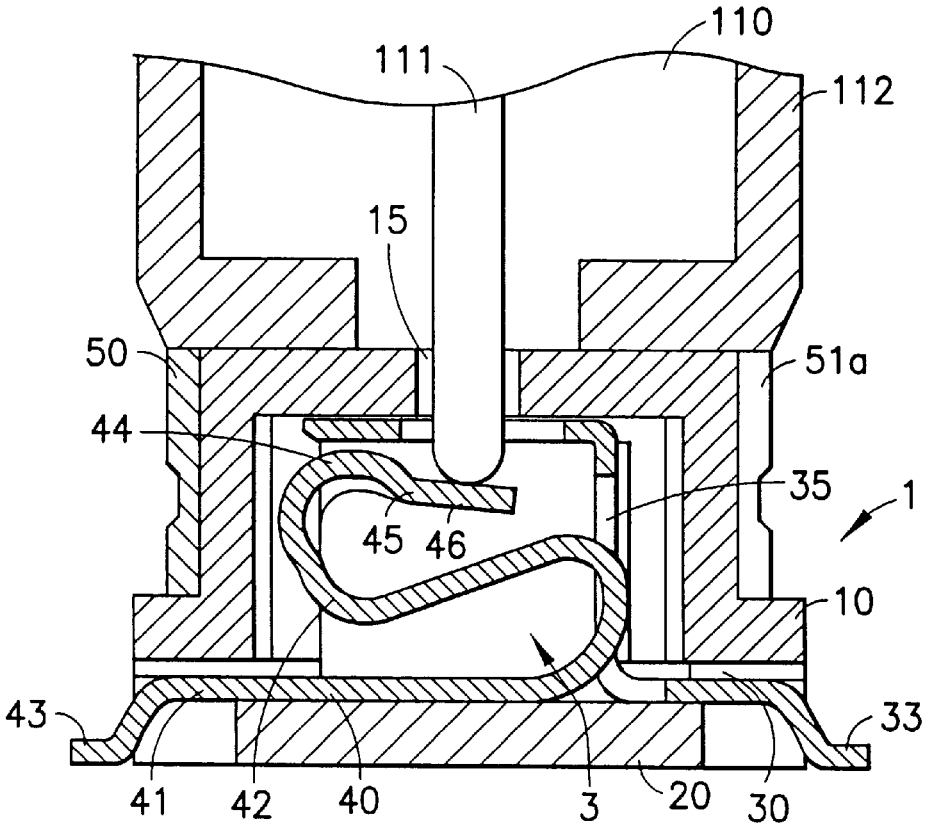
FIG. 5 is a longitudinal sectional view of the coaxial connector of FIG. 4 with a mating connector being inserted.

Referring now to FIG. 5, an operational example is shown with a mating connector 110. In this example, mating connector 110 is an inspection probe. Plug pin 111 provides a connection path to an inspection circuit (not shown). Earth terminal 112 is a sleeve-shaped connector providing a connection to a common ground point.

When mating connector 110 is connected to coaxial connector 1, plug pin 111 is inserted into plug insertion hole 15. Plug pin 111 contacts plug contact portion 46 to electrically connect plug pin 111 and switch terminal 40. In addition, earth terminal 112 contacts an upper end of sleeve-shaped earth shell 50.

Insertion of plug pin 111 also causes cantilevered switch terminal 40 to flex downward. End tip portion 45 is deflected downward and switch terminal 40 flexes along the entire length of S-shaped bent portion 42. When switch terminal 40 flexes downward, movable contact portion 44 separates from fixed contact portion 34. The separation of the contact portions 34, 44 electrically disconnects fixed terminal 30 from switch terminal 40. Accordingly, the signal transmit-receive circuit of a portable telephone is disconnected from an attached antenna and is connected to an inspecting circuit through the plug pin 111.

In this configuration, S-shaped bent portion 42 provides switch terminal 40 with a sufficient spring span to avoid a large bending moment. Plastic deformation is thus avoided, even when switch terminal 40 is repeatedly flexed. Furthermore, switch terminal 40 can accommodate a plug pin 111 that varies within a range of dimensions without becoming plastically deformed.

When mating connector 110 is removed from coaxial connector 1, plug pin 111 is withdrawn from plug insertion hole 15. At this point, contact between switch terminal 40 and plug pin 111 is interrupted. Switch terminal 40 resiliently returns to a position corresponding to prior to mating connector 110 insertion. Movable contact portion 44 again resiliently contacts fixed contact portion 32. Plug contact portion 46 is returns to a position facing plug insertion hole 15.

In the arrangement and operation of the above described embodiment, movable contact portion 44 acts as a normally closed contact and the plug contact portion 46 acts as a normally open contact.

Figure 7:
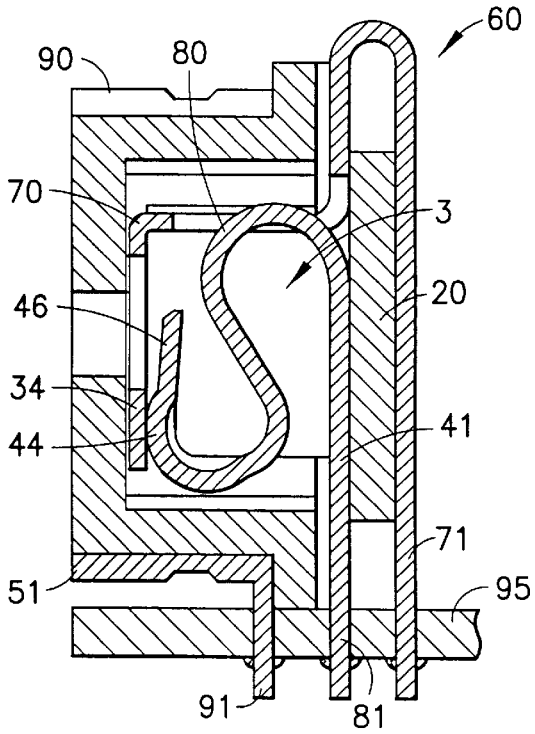
FIG. 7 is a longitudinal sectional view of a coaxial connector with a switch according to another embodiment of the present invention.
Figure 8:
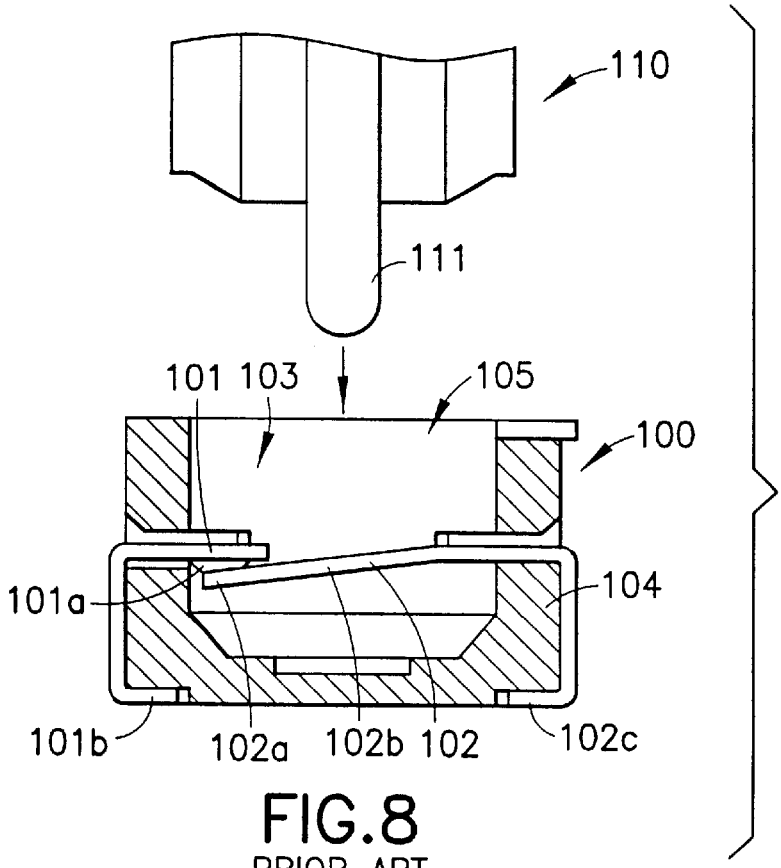
FIG.8 PRIOR ART
FIG. 8 is a transverse sectional view of a conventional coaxial connector with a switch before the insertion of a mating connector.
Figure 9:
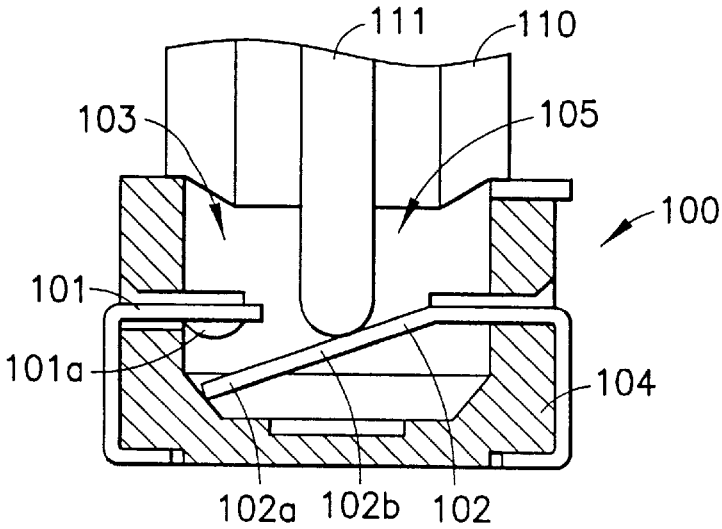
FIG.9 PRIOR ART
FIG. 9 is a transverse sectional view of the coaxial connector of FIG. 8 after the insertion of a mating connector.

Referring now to FIG. 7, a coaxial connector 60 according to another embodiment of the present invention is shown. FIG. 7 is a longitudinal sectional view showing the construction of coaxial connector 60 including a switch. The construction of coaxial connector 60 is substantially the same as the construction of coaxial connector 1. For the sake of clarity, constructs that are the same as those in coaxial connector 1 are designated with the same reference numerals and an explanation thereof is omitted here.

Coaxial connector 60 receives a plug pin 111 that is connected to a mating connector 110. According to this embodiment, plug pin 111 is inserted and withdrawn in a horizontal direction. The arrangement of coaxial connector 60 is substantially that of coaxial connector 1 rotated 90 degrees to be longitudinally oriented. Accordingly, a fixed contact portion 34, a movable contact portion 44 and a plug contact portion 46 are transversely arranged in a vertical direction.

A fixed terminal 70 is attached to a fundamental base 20 from an upper direction. Attached fixed terminal 70 is supported by an upper portion of a terminal storing chamber 3. A switch terminal 80 is attached to fundamental base 20 from a lower direction. Attached switch terminal 80 is supported by a lower portion of terminal storing chamber 3.

Fixed terminal 70 and switch terminal 80 are modified in shape from their counterparts in the above embodiment. The terminals are adapted for use in longitudinally arranged coaxial connector 60 to provide connections with patterns on a printed wiring board 95. Fixed terminal 70, switch terminal 80 and sleeve-shaped earth shell 90 each have respective leg portions 71, 81 and 91. Leg portions 71, 81 and 91 extend downward from coaxial connector 60 and contact patterns on printed wiring board 95. Leg portions 71, 81 and 91 thus provide a connection path between the components of coaxial connector 60 and patterns on printed wiring board 95.

Fixed terminal leg portion 71 of fixed terminal 70 is modified to have a U shape around fundamental base 20 and to extend downward along a rear face of fundamental base 20. Switch terminal leg portion 81 of switch terminal 80 is modified to extend vertically downward in a straight line from a pulling-out portion 41. Earth leg portion 91 of sleeve-shaped earth shell 90 is cut and bent downward from a portion of earth shell body 51. An engaging projection is formed on an end of earth leg portion 91 to engage printed wiring board 95.

Fixed terminal leg portion 71, switch terminal leg portion 81 and earth leg portion 91 extend through printed wiring board 95 and are respectively soldered to corresponding patterns on a lower face of printed wiring board 95.

The S-shaped portion of switch terminal 80 is constructed with a sufficient spring span to avoid plastic deformation when a mating connector (not shown) is inserted. Switch terminal 80 retains a resiliency and sufficient spring span even when the vertical height of switch terminal 80 is reduced. Accordingly, coaxial connector 60 can be reduced in height without a loss of operational functionality.

When switch terminal 80 and fixed terminal 70 are soldered to appropriate patterns on printed wiring board 95, a solder flux flows along the terminals. The flux can cause a poor connection between fixed contact portion 34 and movable contact portion 44. However, the distance over which the flux must travel on switch terminal 80 and fixed terminal 70 is sufficiently long to avoid having any flux reach fixed contact portion 34 and movable contact portion 44.

The above embodiments of the present invention are explained with reference to use in a portable telephone and other similar electronic devices. The embodiments described can be used to switch internal high frequency signals to external connections. It should be recognized, however, that the present invention is not limited to the above described embodiments. For example, the present invention can also be used in applications that call for switching power sources or electric signals. Some examples of such applications include coaxial connectors for earphone jacks and pin jacks.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A coaxial connector with a switch comprising:

an insulative housing;

at least one connector opening in a wall of said housing;

at least one first terminal rigidly affixed in said housing;

a terminal opening in said first terminal;

said terminal opening aligned with said at least one connector opening;

at least one second terminal having a first end and a second end and at least one curved portion therebetween;

said first end rigidly affixed to said housing;

said at least one curved portion being curved whereby said at least one second terminal overlaps itself from a perspective of said terminal opening;

said second end facing said at least one connector opening with said at least one first terminal interposed therebetween;

said second end being resiliently urged toward said at least one first terminal; and said at least one second terminal being exposed to said at least one connector opening to permit deflection of said at least one second terminal away from said at least one connector opening by insertion of a mating connector having a connector pin, whereby a connection between said at least one first terminal and said at least one second terminal is opened.

2. A coaxial connector with a switch according to claim 1, wherein:

said at least one first terminal further includes an escape hole; and a portion of said at least one second terminal passes into said escape hole, whereby said at least one second terminal can have an improved resilience.

3. A coaxial connector with a switch according to claim 2, wherein said at least one curved portion includes a second curved portion whereby said at least one second terminal is curved in an S-shape.

4. A coaxial connector with a switch according to claim 3, wherein:

said second end is inclined away from said at least one connector opening;

said incline of said second end is effective to slidably engage with said at least one first terminal when said at least one first terminal and said at least one second terminal are arranged in said insulative housing; and said incline of second end being further effective to disperse contaminants introduced to said second end.

5. A coaxial connector with a switch according to claim 4, further including:

a first leg portion on an end of said at least one first terminal;

a second leg portion on said first end of said at least one second terminal; and a portion of said at least one first terminal and said at least one second terminal having a length whereby a solder flux flow originating at said first and second leg portions does not reach a contact area of said first and second terminals, respectively.

6. A coaxial connector with a switch according to claim 5, wherein said first and second leg portions extend externally from said coaxial connector in a single direction, whereby said first and second leg portions are effective to pass through patterned openings in a printed wiring board for electrical connection.

7. A coaxial connector with a switch according to claim 1, wherein said at least one curved portion includes a second curved portion whereby said at least one second terminal is curved in an S-shape.

8. A coaxial connector with a switch according to claim 1, further including:

a first leg portion on an end of said at least one first terminal;

a second leg portion on said first end of said at least one second terminal; and a portion of said at least one first terminal and said at least one second terminal having a length whereby a solder flux flow originating at said first and second leg portions does not reach a contact area of said first and second terminals, respectively.

9. A coaxial connector with a switch comprising:

an insulative housing;

at least one conductive strip on an exterior of said housing;

at least one connector opening in a wall of said housing;

at least one first terminal rigidly affixed in said housing;

a terminal opening in said at least one first terminal;

said terminal opening substantially aligned with said at least one connector opening;

at least one second terminal having a first end and a second end;

said first end rigidly affixed to said housing;

said second end facing said at least one connector opening with said at least one first terminal interposed therebetween;

said second end being resiliently urged toward said at least one first terminal; and said at least one second terminal being exposed to said at least one connector opening to permit deflection of said at least one second terminal away from said at least one connector opening by insertion of a mating connector having a connector pin, whereby a connection between said at least one first terminal and said at least one second terminal is opened.

10. A coaxial connector with a switch according to claim 9, wherein:

said at least one conductive strip is a substantially cylindrical conductive shell disposed on an outer surface of said housing; and said conductive shell having a substantially circular edge effective to provide a ground connection with an outer circumferential ground of a mating connector.

11. A coaxial connector with a switch according to claim 10, wherein:

said at least one first terminal further includes an escape hole; and a portion of said at least one second terminal passes into said escape hole, whereby said at least one second terminal can have an improved resilience.

12. A coaxial connector with a switch according to claim 11, wherein said at least on at least one second terminal is curved in substantially an S-shape.

13. A coaxial connector with a switch according to claim 12, further including:

a first leg portion on an end of said at least one first terminal;

a second leg portion on said first end of said at least one second terminal; and a portion of said at least one first terminal and said at least one second terminal having a length, whereby a solder flux flow originating at said first leg portion and said second leg portion does not reach a contact area of said at least one first and second terminals, respectively.

14. A coaxial connector with a switch according to claim 13, wherein:

said second end has an incline away from said at least one connector opening;

said incline is effective to slidably engage said at least one first terminal when said at least one first terminal and said at least one second terminal are arranged in said housing; and said incline being further effective to disperse contaminants introduced to said second end.

15. A coaxial connector with a switch according to claim 14, further including:

a third leg portion on said conductive shell; and said first, second and third leg portions extend externally from said coaxial connector in a single direction, whereby said leg portions are effective to pass through patterned openings in a printed wiring board for electrical connection.

16. A coaxial connector with a switch according to claim 9, wherein said at least one second terminal is curved in an S-shape.

17. A coaxial connector with a switch according to claim 16, further including:

a first leg portion on an end of said at least one first terminal;

a second leg portion on said first end of said at least one second terminal; and a portion of said at least one first terminal and said at least one second terminal having a length whereby a solder flux flow originating at said first and second leg portions does not reach a contact area of said at least one first and second terminals, respectively.

18. A coaxial connector with a switch according to claim 17, wherein:

said second end has an incline away from said at least one connector opening;

said incline is effective to slidably engage said at least one first terminal when said at least one first terminal and said at least one second terminal are arranged in said housing; and said incline being further effective to disperse contaminants introduced to said second end.

19. A coaxial connector with a switch comprising:

at least one fixed terminal including an opening;

a fixed contact on a side of said opening;

at least one switch terminal curved in an S-shape;

said at least one switch terminal including a movable contact and a connector contact;

said at least one switch terminal opposed to said opening and resiliently urged toward said at least one fixed terminal, whereby said fixed contact and said movable contact connect;

said connector contact being externally accessible; and said connector contact being connectable to and deflectable by an external connector, whereby said at least one switch terminal resiliently flexes and opens a connection between said fixed contact and said movable contact.

20. A coaxial connector with a switch according to claim 19, further including:

an insulative housing;

at least one connector opening in a wall of said housing;

said at least one switch terminal and said at least one fixed terminal affixed to said housing;

said connector contact portion being opposed to and slanted away from said at least one connector opening; and said fixed contact and said movable contact are a distance along said at least one fixed terminal and said at least one switch terminal, respectively, whereby a solder flux flow along said terminals does not reach said fixed contact portion and said movable contact portion.

* * * * *